US006464067B1

(12) United States Patent
Reist

(10) Patent No.: US 6,464,067 B1
(45) Date of Patent: Oct. 15, 2002

(54) METHOD AND DEVICE FOR STORING TRANSPORT ELEMENTS

(75) Inventor: Walter Reist, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/554,983

(22) PCT Filed: Dec. 8, 1998

(86) PCT No.: PCT/CH98/00527

§ 371 (c)(1),
(2), (4) Date: May 22, 2000

(87) PCT Pub. No.: WO99/33733

PCT Pub. Date: Jul. 8, 1999

(30) Foreign Application Priority Data

Dec. 23, 1997 (CH) ..... 2966/97

(51) Int. Cl.[7] ..... B65H 25/02

(52) U.S. Cl. ..... 198/465.4; 198/687.1; 198/867.08

(58) Field of Search ..... 198/687.1, 465.4, 198/867.05, 644; 271/280, 285

(56) References Cited

U.S. PATENT DOCUMENTS

| | | | | |
|---|---|---|---|---|
| 3,032,341 A | | 5/1962 | Reist | 271/79 |
| 3,948,551 A | | 4/1976 | Reist | 294/16 |
| 4,036,356 A | | 7/1977 | Reist | 198/680 |
| 5,261,520 A | | 11/1993 | Duke | 198/375 |
| 5,755,436 A | | 5/1998 | Reist | 271/204 |
| 5,819,906 A | * | 10/1998 | Enderlein et al. | 198/687.1 |

FOREIGN PATENT DOCUMENTS

| | | |
|---|---|---|
| CH | 382768 | 10/1964 |
| CH | 382 768 A | 12/1964 |
| CH | 569167 | 11/1972 |

* cited by examiner

*Primary Examiner*—D. Glenn Dayoan
*Assistant Examiner*—Patricia L. Engle
(74) *Attorney, Agent, or Firm*—Brinks Hofer Gilson & Lione

(57) ABSTRACT

The invention relates to a method and device for buffering with the use of a closed gripper. The invention comprises transport means (20) which are provided with grippers (22), can move along a conveying section (10), and are located in the area of a buffer section (14) of the conveying section (10). Transport means are stored in such a way that the distance between the transporting means (20), said means being successively arranged in the buffer section (14), is essentially determined by the degree of opening of the grippers (22) or by the dimensions of the transport means (20). Said means are also stored in such a way that opened grippers (22) are at least partially closed without exercising a holding function in or before the area of the buffer section (14). To this end, a closing device is placed in an entry area (16) of the buffer section (14) which, for example, can be provided in the form of a closing connecting member (18) and can be displaced along the conveying section (10).

19 Claims, 1 Drawing Sheet

METHOD AND DEVICE FOR STORING TRANSPORT ELEMENTS

Figure 1:
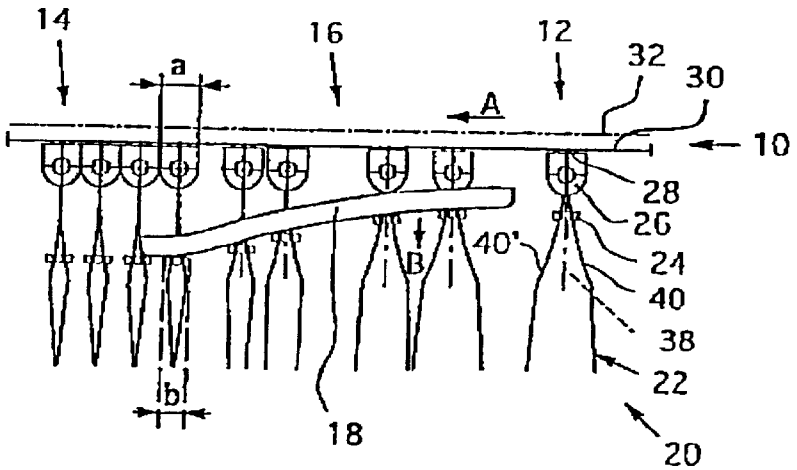

The present invention relates to a method of, and an apparatus for, storing transporting elements according to the preambles of Claim 1 and Claim 9, respectively.

Conveying installations with conveying paths along which certain products can be conveyed with the aid of grippers are used in a wide range of industrial sectors, for example in the printing industry. Transporting means which are coupled in each case to the grippers have to be stored on an intermediate basis in such conveying installations in certain applications. In particular, there is also the need for these gripper-coupled transporting means to be stored on an intermediate basis when the grippers are not retaining any products.

Swiss Patent CH 382 768 discloses a buffer path in which, on account of the amount of storage space required by the gripper-coupled transporting means, only a relatively small number of transporting means can be stored in a buffer path of predetermined length.

Less storage space is required by grippers and transporting means according to Swiss Patent CH 569 197, although this advantage disadvantageously requires grippers and transporting means to be pivoted through 90° if a product is to be gripped by a gripper.

The object of the invention, then, is to make it possible for the transporting means to be stored, without any significant disadvantages being created in the process, such that they require the smallest possible amount of storage space.

The method according to the invention provides that the storage space for transporting means is determined by the degree of opening of its gripper or—in the case of grippers which are closed to a sufficiently pronounced extent—by the dimensions of the transporting means, and open grippers are at least partially closed, without performing a retaining function, before the transporting means which are coupled to said grippers are fed to a buffer path. This means that, with the same number of stored transporting means, the transporting means take up a shorter buffer path than in cases based on known principles, in which open grippers which take up a relatively large amount of space and are in contact with one another pass into a buffer path with the transporting means spaced apart from one another.

Since, according to the invention, a comparatively large number of transporting means can be stored in a buffer path, it is advantageously possible for these to be moved relatively slowly within the buffer path—if this is a constituent part of a conveying path—or to be introduced into the buffer path, or retrieved therefrom, at low speed.

It is preferred if the transporting means are conveyed along the buffer path, and the grippers are conveyed to such an extent that their dimensions in the conveying direction are smaller than or equal to the dimensions of the transporting means in the conveying direction.

The grippers may be closed, for example, in that, in the inlet region of the buffer path, the transporting means are conveyed past a closing device, for example a closing guide, which then, e.g. in interaction with a closing element of the gripper, close [sic] the latter.

The transporting means may be conveyed individually and independently of one another, continuously or intermittently in the conveying path. This can take place either actively, by each transporting element being coupled to a drive means via a retaining part, by means of which it is retained and guided in a guide element of the conveying path, or else in that only individual transporting means are driven, these then pushing other, non-driven transporting means in front of them. Alternatively, however, it is also possible for the transporting means to be moved along the conveying path, e.g. in a state in which they are decoupled from drive means, on account of an impulse imparted to each transporting means, or merely to individual transporting means, or on account of their own gravitational force.

In a buffer path according to the invention, it is basically possible to store transporting means which are coupled to a driving means or are uncoupled from a driving means. It is thus possible to buffer-store transporting means with or without drive means.

In a preferred embodiment of the invention, a closing device can be moved along the conveying path. This displacement possibility makes it possible for the length of the buffer path to be coordinated with the number of transporting elements which are to be stored. It is thus possible, for example, to react in a flexible manner to irregularities occurring in the operating speed of certain operating stations.

In a particularly preferred embodiment of the invention, the transporting means, as they leave the buffer path, are guided past an opening device, which may be configured, for example in the form of an opening guide, with the result that only transporting means which are ready for receiving purposes, i.e. transporting means with open grippers, are available downstream of the buffer path, as seen in the conveying direction. The opening movement of the gripper legs preferably takes place here in the conveying direction.

In that region of the conveying path which is located outside the buffer path, the distance between the centers of two successive transporting means is preferably always somewhat smaller than or equal to the maximum distance between two gripping legs of an open gripper. This ensures that the gripping legs of adjacent transporting means, in the open state, are always in contact with one another and fix their alignment in relation to the conveying path.

In order to implement the method, use may be made of a conveying installation according to Claim 9 which has a closing device just upstream of the buffer path or in the inlet region of the same. It is likewise possible for the closing device to be arranged such that the grippers are closed immediately following a product-discharging operation, with the result that the gripper is ready for being stored on an intermediate basis immediately following said product-discharging. operation. The closing device may be designed in the form of a closing guide which may preferably be displaced along the conveying path, with the result that the length of the buffer path can be adjusted in a variable manner in accordance with the respective requirements.

At the end of the buffer path, it is possible to provide an opening device, e.g. in the form of an opening guide, which ensures that only transporting means with open grippers leave the buffer path.

If the closing and opening device can be optionally activated and deactivated, entire buffer paths can be connected up and disconnected as required.

A specific advantage is achieved if the three-dimensional extent of the transporting means in the conveying direction, with grippers projecting perpendicularly from the conveying path, is smaller than or approximately equal to the extent of the closed gripper in the conveying direction.

Further preferred types of method and advantageous configurations of the conveying installation in conjunction with the method according to the invention form the subject matter of the subclaims.

Figure 2:
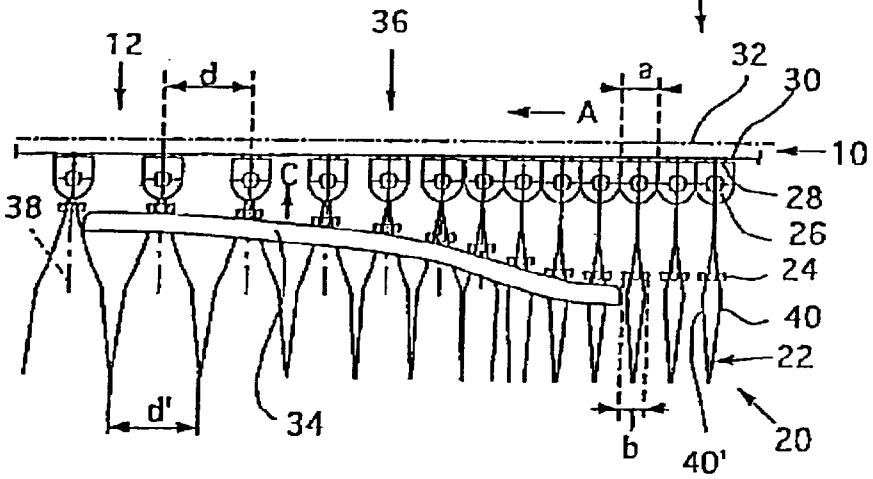

The invention is explained by way of example hereinbelow with reference to FIGS. 1 to 2, in which, purely schematically:

FIG. 1 shows a detail of a conveying path according to the invention with a section of a transporting path and an inlet region of a buffer path with closing guide, said inlet region adjoining the transporting path; and FIG. 2 shows a detail of a conveying path according to the invention with an opening guide in the outlet region of a buffer path and with a transporting-path section which adjoins the outlet region.

FIG. 1 shows a detail of a conveying path 10 with a section of a transporting path 12 and a buffer path 14 which is arranged downstream of said transporting path 12, as seen in the conveying direction A, and has a closing guide 18 in its inlet region 16. Located in the conveying path 10 are transporting means 20 with grippers 22 which have a closing/opening element 24. The grippers 22 are connected to a retaining part 28 (merely indicated in the illustration), via a bearing element 26. The retaining part 28 retains the transporting means 20 in a schematically illustrated guide element 30 of the conveying path 10. For conveying purposes, the transporting means 20 may be coupled, via their retaining parts 28, to a drive means 32 (likewise merely schematically illustrated) of the conveying path 10.

As seen in the conveying direction A in each case, the bearing elements 26 of the transporting means 20 have an extent a which is only slightly greater than the dimension of a width b of the closed grippers 22. The retaining parts 28 are formed such that they do not prevent the mutual contact of successive bearing elements 26 in the buffer path 14. As can be seen from FIG. 1, the distance between the transporting means 20 stored in the buffer path 14 is essentially determined by the dimensions of the bearing elements 26, which are a constituent part of the transporting means 20. If the bearing elements should be designed to be even smaller than is illustrated in FIG. 1, said distance would be predetermined by the dimensions of the closed grippers 22.

FIG. 1 illustrates how a transporting means 20 whose gripper 22 is open is conveyed, in the conveying direction A, from the transporting path 12 to the inlet region 16 of the buffer path 14.

In the inlet region 16 of the buffer path 14, the transporting means 20 is conveyed past a closing guide 18 which can be displaced, in particular, in the conveying direction. The closing guide 18 acts on the closing/opening element 24 provided on the gripper 22 and displaces the same in the direction B, with the result that the gripper 22 is closed, without performing a retaining function. Only transporting means 20 with closed grippers 22 are thus stored on the buffer path 14. This reduces the length of the buffer path 14 which is required for storage purposes.

FIG. 2 illustrates an opening guide 34 in the outlet region 36 of a buffer path 14 and a section of the adjoining transporting path 12. The transporting means 20, which are approximately of axis-symmetrical construction, have their axes of symmetry 38 spaced apart from one another, in the region of the transporting path 12, more or less by an ideal distance d, which is approximately equal to the distance d' between two gripping legs 40, 40', which form the gripper 22, in the open state. This ensures that the gripping legs 40, 40' of two adjacent transporting means 20 are in contact with one another, in particular under mechanical stressing.

The situation illustrated in FIG. 2 shows how the transporting means 20 which are stored in the buffer path 14 with closed grippers 22, which do not perform any retaining function, are conveyed past the opening guide 34 in the outlet region 36 of the buffer path 14. In this case, the opening guide 34 acts on the closing/opening element 24 of the grippers 22 and displaces the same in the direction C, with the result that the grippers 22 are opened. At least the beginning of this movement of the closing/opening element 24 is assisted in that the bearing elements 26 are in contact with one another and supported against one another, as a result of which good transmission of force to the closing/opening element 24 becomes possible.

During the opening movement of the grippers 22, the transporting means 20 are accelerated—if appropriate by suitable accelerating means—and/or coupled to the drive means 32 by way of their retaining parts 28 such that they can be conveyed further on the transporting path 12, which adjoins in the conveying direction A, at a distance apart from one another such that the open grippers 22 are in contact with one another in the manner described by way of their gripping legs 40, 40'. The transporting means 20 thus leave the buffer path 14 in a state in which they are ready for receiving purposes, i.e. with open grippers 22.

As can be seen from FIG. 2, the transporting means 20 are conveyed in the transporting path 12, which follows the buffer path 14, in a state in which they are spaced apart from one another by the ideal distance d, with the result that the legs 40, 40' of the grippers 22 are in contact with one another and form a continuous zigzag line. It is thus not possible for sheet-like products which are to be fed at a later point in time to pass between two adjacent grippers 22.

The transporting means 20 may be retrieved individually or in groups from the buffer path 14 by suitable means, e.g. by mechanical release means.

The buffer paths 14 illustrated in FIGS. 1 and 2 are illustrated in each case as an integral constituent part of the respective conveying path 10. However, it is also conceivable for these buffer paths 14, rather than being configured as a fixed constituent part of the conveying path 10, to be such that they can be removed from the conveying path 10 and replaced by other buffer or conveying paths. This is advantageous, for example, when it is desired for transporting elements 20 to be stored on an intermediate basis, and thus removed from the conveying path 10, for a relatively long period of time.

What is claimed is:

1. Method for storing transporting means in a region of a buffer path, the transporting means being the type that are provided with grippers for retaining products and which are moved along a conveying path in a conveying direction, comprising the steps of:

moving the transporting means towards the buffer path with grippers that are open and not performing a product retaining function;

closing at least partially the open grippers in the region of the buffer path or upstream thereof, storing the transporting means with the at least partially closed grippers in the region of the buffer path such that the distance between transporting means following one after the other in the buffer path is determined essentially by the degree that the grippers are open or the dimensions of the transporting means in the conveying direction.

2. The method according to claim 1, characterized in that the grippers are closed at least to such an extent that their dimensions in the conveying direction are smaller than or equal to the average dimensions of the transporting means in the conveying direction.

3. The method according to claim 1 or claim 2, characterized in that the transporting means are conveyed continuously or intermittently along the buffer path.

4. The method according to one of claim 1 or 2, characterized in that the transporting means are conveyed past a closing device which is provided in an inlet region of the buffer path.

5. The method according to claim 4, characterized in that the closing device is displaceable along the conveying path.

6. The method according to one of claim 1 or 2, characterized in that in the buffer path the transporting means follow one after the other so closely that adjacent transporting means are in contact with one another.

7. The method according to one of claim 1 or 2, characterized in that the grippers of the transporting means are opened again in the outlet region of the buffer path or downstream of the buffer path.

8. The method according to claim 7, characterized in that, the grippers are conveyed past an opening device.

9. The method according to claim 7, characterized in that the distance between the transporting means is increased as the transporting means leave the buffer path.

10. The method according to claim 9, characterized in that the distance between the transporting means is increased in such a way that the gripping legs of adjacent, open grippers are in contact with one another.

11. The method according to one of claim 1 or 2, characterized in that the transporting means are stored in a buffer path which is located outside the conveying path or is an exchangeable constituent part of the conveying path.

12. The method according to one of claim 1 or 2, characterized in that the transporting means are retrieved individually or in groups from the buffer path.

13. Apparatus for storing in a region of a buffer path transporting means which are provided with grippers for retaining products, and which are moved along a conveying path in a conveying direction, comprising:

a buffer path, means for moving the transporting means towards the buffer path with grippers which are open and do not perform a product retaining function;

a closing device arranged upstream of the buffer path or in the inlet region thereof for closing at least partially the open grippers in the region of the buffer path or upstream thereof, means for storing the transporting means with the at least partially closed grippers in the region of the buffer path such that the distance between transporting means following one after the other in the buffer path is determined essentially by the degree of opening of the grippers or the dimensions of the transporting means in the conveying direction.

14. Apparatus according to claim 13, characterized in that the closing device is displaceable along the conveying path.

15. Apparatus according to claim 13, characterized in that an opening device for opening the grippers is provided downstream of the buffer path or in the outlet region, thereof.

16. Apparatus according to claim 15, characterized in that the opening device is displaceable along the conveying path.

17. Apparatus according to claim 13, characterized in that the closing device is activatable and disactivatable.

18. Apparatus according to claim 13 characterized in that the dimensions of the partially or fully closed grippers in the conveying direction are smaller than or equal to the overall dimensions of the transporting means in the conveying direction.

19. Apparatus according to claim 13, characterized in that the opening device is activatable and disactivatable.

* * * * *

UNITED STATES PATENT AND TRADEMARK OFFICE

CERTIFICATE OF CORRECTION

PATENT NO. : 6,464,067 B1
DATED : October 15, 2002
INVENTOR(S) : Walter Reist

It is certified that error appears in the above-identified patent and that said Letters Patent is hereby corrected as shown below:

Title page,
Item [22], delete "Dec. 8," and substitute -- Dec. 9, -- in its place.

Signed and Sealed this

Twenty-ninth Day of July, 2003

JAMES E. ROGAN
*Director of the United States Patent and Trademark Office*